United States Patent [19]

Yamaguchi

[11] Patent Number: 4,589,512

[45] Date of Patent: May 20, 1986

[54] MOTORCYCLE RADIATOR

[75] Inventor: Ken Yamaguchi, Saitama, Japan

[73] Assignee: Honda Giken Kogyo Kabushiki Kaisha, Tokyo, Japan

[21] Appl. No.: 540,422

[22] Filed: Oct. 7, 1983

[30] Foreign Application Priority Data

Oct. 7, 1982 [JP] Japan ..... 57-152655[U]

[51] Int. Cl.[4] ..... B60K 11/04

[52] U.S. Cl. ..... 180/229; 165/41

[58] Field of Search ..... 165/41, 125, 44; 180/229

[56] References Cited

U.S. PATENT DOCUMENTS

| | | | |
|---|---|---|---|
| 2,067,758 | 1/1937 | Flogaus | 165/125 |
| 4,016,945 | 4/1977 | Shibata | 180/229 |
| 4,171,729 | 10/1979 | Shibata | 180/229 |
| 4,180,137 | 12/1979 | Wagner | 180/229 |
| 4,428,451 | 1/1984 | Yamaoka | 165/41 |
| 4,461,366 | 7/1984 | Honda | 180/229 |
| 4,478,306 | 10/1984 | Tagami | 180/229 |

FOREIGN PATENT DOCUMENTS

| | | | |
|---|---|---|---|
| 892724 | 8/1953 | Fed. Rep. of Germany | 180/229 |
| 138714 | 2/1920 | United Kingdom | 180/229 |

*Primary Examiner*—Sheldon J. Richter

*Attorney, Agent, or Firm*—Lyon & Lyon

[57] ABSTRACT

A radiator circular or conical in shape for a motorcycle which may be advantageously located in a position adjacent the motorcycle in an arrangement similar to that of a muffler. The radiator includes a core of ring-shaped cross section with an inlet tank and an outlet tank. The inlet and outlet tanks may be positioned on either end of the radiator with radiator tubes extending generally longitudinally therebetween. Alternately, the tubes may be ring-shaped with the inlet and outlet tanks arranged generally along the longitudinal direction. A plurality of corrugated or plate fins may be used to enhance heat transfer. A plate may be positioned at one end of the radiator to insure radial air flow through the core thereof.

1 Claim, 7 Drawing Figures

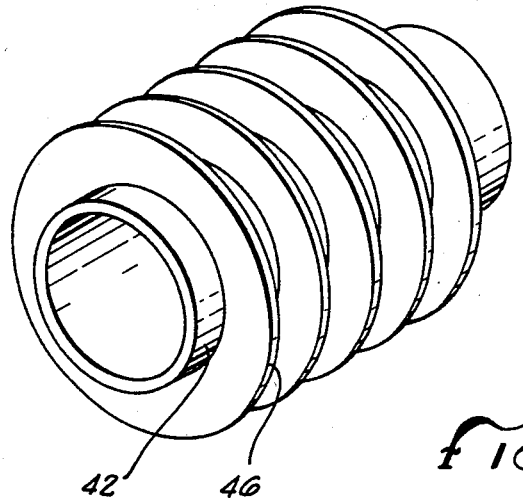
FIG. 3.
FIG. 4.
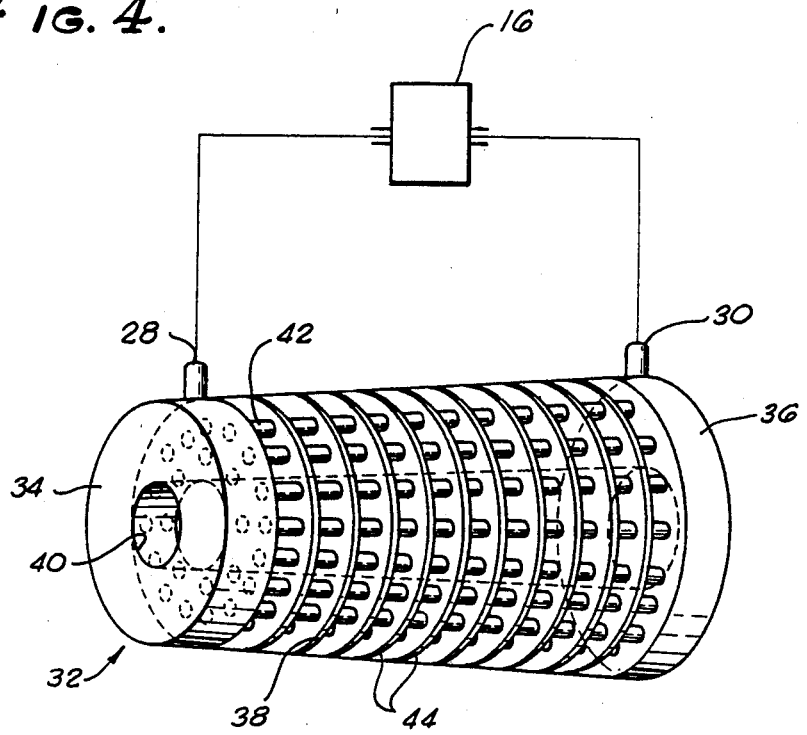

FIG. 6.
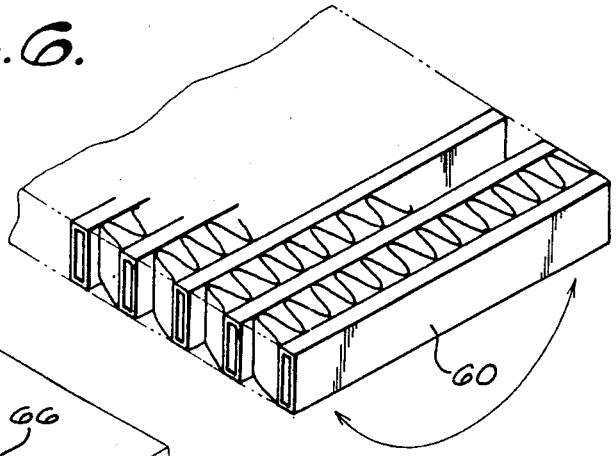
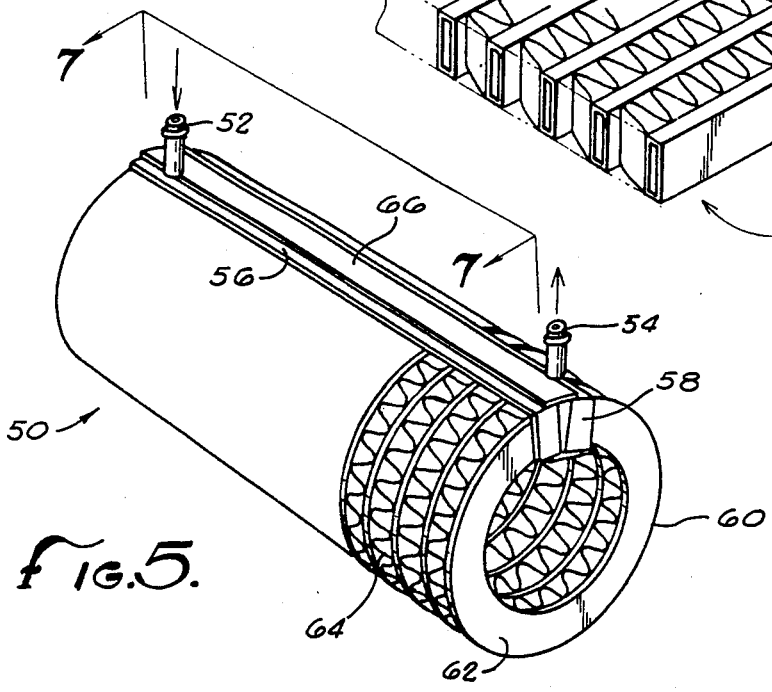
FIG. 5.
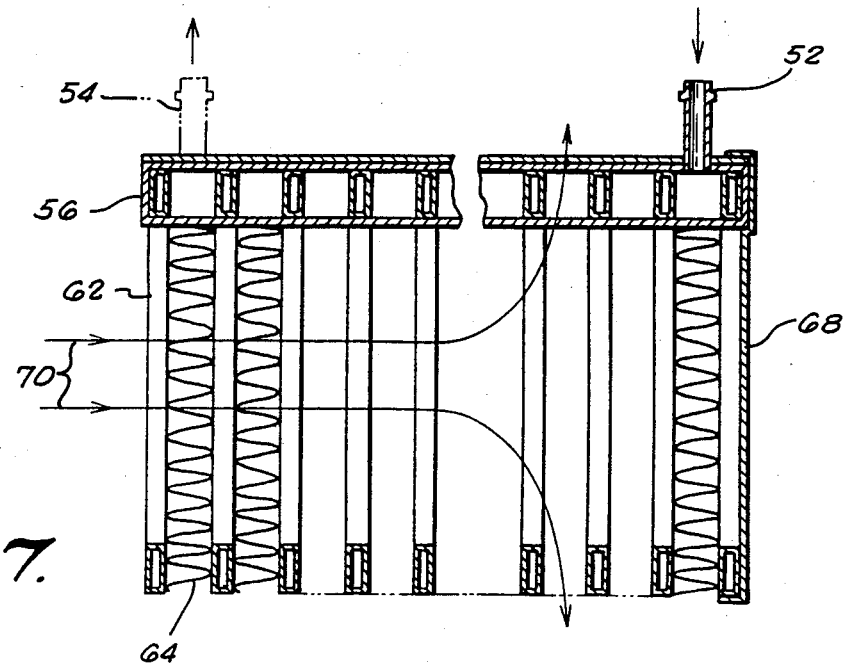
FIG. 7.

MOTORCYCLE RADIATOR

BACKGROUND OF THE INVENTION

The field of the present invention is radiators for motorcycles.

With recent air pollution requirements, increased demands for efficiency and the like for motorcycles, a variety of water-cooled engine motorcycle designs have been developed. There are certain advantages to water-cooled systems, but certain disadvantages have also been found. Motorcycles generally require compact designs which are also relatively lightweight. Water cooling systems both add weight and require greater space allocation than air-cooled systems. In attempting to minimize these disadvantages, motorcycle radiators have generally been located between the front fork of the motorcycle and the engine. Such placement is relatively compact, aesthetically acceptable and concentrates the weight at a central location. However, the location of the radiator behind the front fork leads to certain inefficiencies in air flow and heat transfer. Ideally, the radiator should be mounted in the area of the headlight. This is aesthetically unacceptable, and appropriately distributes the additional weight and creates engine coolant pumping inefficiencies. Thus, difficulties have been experienced with the employment of water-cooled engines on motorcycles.

SUMMARY OF THE INVENTION

The present invention pertains to a radiator employed on a motorcycle. The radiator may be configured in a cylindrical or conical shape having the advantage that it may be placed in a position similar to that of the motorcycle exhaust system. In this way, a radiator or auxiliary radiator for either engine coolant or engine lubricant may be advantageously employed.

The cylindrical or conical shape of the radiator allows the radiator to be arranged in a position similar to that of a muffler on the motorcycle, namely, rearwardly of the engine in a location on one side of the motorcycle. The weight of such a cooling system would then be advantageously positioned in a compact manner also resulting in an aesthetically-pleasing appearance. Furthermore, the location of the radiator may be positioned for advantageous air flow therethrough.

In defining the overall shape of the radiator, the tubes of the radiator core may either be ring-shaped with an inlet tank and outlet tank arranged generally parallel to the axis of the radiator. Alternatively, the tubes of the core may extend parallel to the axis of the radiator with ring-shaped tanks at either end thereof. Cooling fins may employ a variety of configurations and air flow may be forced through the ring-shaped core through the employment of a plate preventing flow axially through the radiator.

Accordingly, it is an object of the present invention to provide an improved radiator having particular advantage on motorcycles. Other and further objects and advantages will appear hereinafter.

BRIEF DESCRIPTION OF THE DRAWINGS

FIG. 3 is a detail illustrating one possible fin configuration.

FIG. 4 is an oblique view of a second embodiment of the present invention.

FIG. 5 is an oblique view of yet another embodiment of the present invention.

FIG. 6 is an oblique view of the core illustrated in flat arrangement prior to formation of the radiator of FIG. 5.

FIG. 7 is a cross-sectional view taken along line 7—7 of FIG. 5.

DETAILED DESCRIPTION OF THE PREFERRED EMBODIMENT

Figure 1:
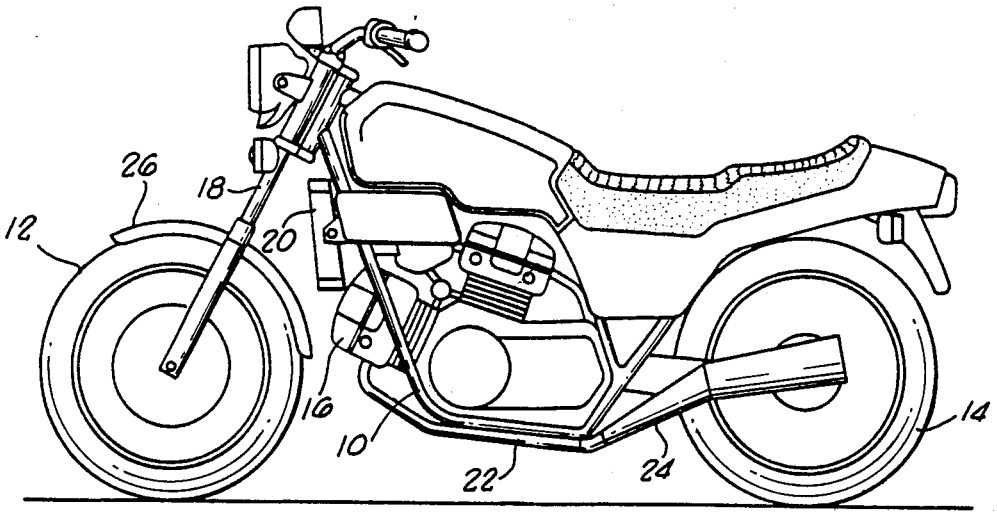
FIG. 1 is a side elevation of a motorcycle which may employ the present invention.

Turning in detail to the drawings, a motorcycle is illustrated in FIG. 1 as including a body 10, a front wheel 12, a rear wheel 14 and an engine 16. The front wheel 12 is associated with the motorcycle by means of a front fork assembly 18. A radiator 20 is illustrated in the traditional position between the front fork assembly and the engine 16. An exhaust system 22 extends rearwardly to a muffler assembly 24. It can be seen in this arrangement which does employ a conventional radiator 20 that a substantial amount of room is necessary to avoid interference of the radiator 20 with the front wheel 12 and its associated front fender 26.

Figure 2:
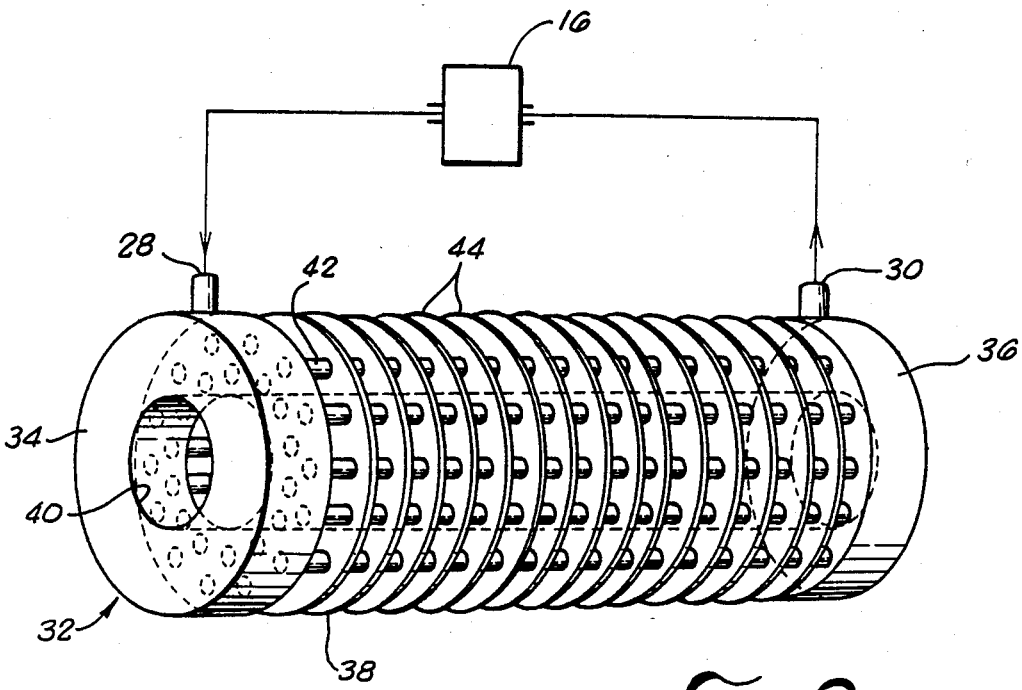
FIG. 2 is an oblique view of a first embodiment of the present invention.

The embodiment of FIG. 2 schematically illustrates and engine 16 coupled to a radiator inlet 28 and radiator outlet 30. The radiator, generally designated 32, includes an inlet tank 34 associated with the inlet 28. An outlet tank 36 is arranged at the other end of the radiator 32 from the inlet tank 34. A core 38 forming a ring in cross-section extends and is in communication between the tanks 34 and 36. The core 38 defines in this first embodiment of FIG. 2 a cylinder which is generally ring-shaped in configuration in that a hollow center is defined within the core. The inlet tank 34 also includes a passageway 40 making that tank ring-shaped as well. The outlet tank 36 may or may not include a passageway through the center thereof depending on the desired air flow. A substantially identical construction is illustrated in the embodiment of FIG. 4 which is conical in overall construction rather than cylindrical. The same numbers have been employed with regard to FIG. 4 as employed in FIG. 2 due to the substantial similarity therebetween.

The cores 38 of the embodiments of either FIG. 2 or FIG. 4 include tubes 42. The tubes 42 extend parallel to the center axis of the cylindrical core 38 in the embodiment of FIG. 2 and parallel to the conical elements of formation of the cone defined by the core 38 in the embodiment of FIG. 4. Associated with the tubes 42 in the cores 38 are cooling fins 44. The cooling fins illustrated in FIGS. 2 are ring plates having a central hole therethrough for passage of incoming cooling air. The fins 44 are associated with the tubes 42 for efficient heat transfer therebetween to aid in tube cooling. An alternate cooling fin 46 for each of the tubes 42 is illustrated in FIG. 3.

Looking then to the embodiments of FIGS. 5, 6 and 7, a radiator similar in overall shape is illustrated. The radiator 50 again may be cylindrical, conical or other ring-shaped configuration, such as elliptical, in shape. Again, an inlet 52 and an outlet 54 communicate with the cooling system of the engine.

The radiator 50 includes an inlet tank 56 and an outlet tank 58. The inlet tank 56 and outlet tank 58 are elongate and generally parallel to the axis of the cylindrical shape of the radiator 50. The tanks 56 and 58 are also adjacent as can best be seen in FIG. 5. A core 60 is associated with the tanks 56 and 58 such that the core 60 extends between the tanks in communication therewith.

The core 60 includes tubes 62 which extend in a circular ring shape between the tanks. Corrugated cooling fins 64 are conveniently arranged between the tubes 62. The tubes 62 are also rectangular in cross section to more advantageously accommodate heat transfer between the tubes 62 and the corrugated fins 64. As can be seen in FIG. 6, the core 60 may be originally constructed in planar configuration and then bent about an axis to form the resulting radiator.

To insure adequate cooling air flow through the radiator 50, a closure plate 66 may extend between the tanks 56 and 58. An end plate 68 is shown to extend over one end of the radiator 50 which is the downstream end. Air flow, as illustrated in FIG. 7 by arrows 70 is then brought into the center of the core 60 and allowed to pass radially outwardly between the tubes 62. A similar arrangement employing either a solid radiator or an end plate may be employed with the embodiments of FIGS. 2 and 4.

Naturally, the arrangement of the radiator in a location similar to that of the muffler assembly but on the opposite side of the motorcycle may be best configured for maximum air flow therethrough. Additional ducting may be employed for either or both improved air flow and aesthetics.

Thus, an improved water cooling system for a motorcycle incorporating a cylindrical or conical radiator has been described. While embodiments and applications of this invention have been shown and described, it would be apparent to those skilled in the art that many more modifications are possible without departing from the inventive concepts herein. The invention, therefore, is not to be restricted except in the spirit of the appended claim.

What is claimed is:

1. A motorcycle having a radiator and an exhaust system extending rearwardly along one side of the motorcycle including a muffler circular in cross section, said radiator comprising an inlet tank;

an outlet tank; and a radiator core between said inlet tank and said outlet tank, said core including a plurality of tubes extending in communication between said inlet tank and said outlet tank, said radiator having a shape to simulate the muffler and positioned on the opposite side of the motorcycle from the muffler.

* * * * *